United States Patent [19]

Schwartz et al.

[11] 4,438,479

[45] Mar. 20, 1984

[54] SELF-CONTAINED ANTI-STATIC ADAPTER FOR COMPRESSED GAS DUST BLOWING DEVICES

[75] Inventors: Lionel H. Schwartz, Short Hills, N.J.; Scott W. Miller, Stratford, Conn.; Christopher N. Severud, Jr., Denville, N.J.

[73] Assignee: Falcon Safety Products, Inc., Mountainside, N.J.

[21] Appl. No.: 243,559

[22] Filed: Mar. 13, 1981

[51] Int. Cl.[3] ..... H05F 3/00

[52] U.S. Cl. ..... 361/213; 361/220; 239/690; 222/180

[58] Field of Search ..... 361/213, 212, 220; 239/690; 222/180, 190

[56] References Cited

U.S. PATENT DOCUMENTS

| | | | |
|---|---|---|---|
| 2,048,490 | 7/1936 | Bilstein . | |
| 2,264,683 | 12/1941 | Smith . | |
| 2,479,882 | 8/1949 | Wallhausen et al. . | |
| 2,972,086 | 2/1961 | Nau-Touron | 361/213 |
| 2,973,292 | 2/1961 | Yanko et al. . | |
| 3,111,605 | 11/1963 | Müller et al. . | |
| 3,191,094 | 6/1965 | Kleinhaus . | |
| 3,309,569 | 3/1967 | Heyl et al. . | |
| 3,395,865 | 8/1968 | McKinnon . | |
| 3,531,688 | 9/1970 | Jackson . | |
| 3,611,030 | 10/1971 | Herbert, Jr. . | |
| 3,619,615 | 11/1971 | Fish | 250/106 |
| 3,818,545 | 6/1974 | Olson et al. | 361/213 |
| 4,111,338 | 9/1978 | Cheng et al. | 222/180 |

OTHER PUBLICATIONS

"Static Master", Modern Products to Eliminate Static Electricity.

*Primary Examiner*—Reinhard J. Eisenzopf

[57] ABSTRACT

An anti-static adapter which enhances the operation of compressed gas dust blowing devices by allowing the safe use of a radioactive source to ionize a gas stream. The adapter may be used and handled safely without special precautions on the part of the operator.

11 Claims, 14 Drawing Figures

SELF-CONTAINED ANTI-STATIC ADAPTER FOR COMPRESSED GAS DUST BLOWING DEVICES

BACKGROUND OF THE INVENTION

The present invention relates generally to an improved compressed gas dust blowing device which enhances the ability of such devices to eliminate loose dust, lint and other surface adherents from surfaces and devices such as photographic, audio, and video equipment and materials. More particularly, the present invention relates to an anti-static adapter for conventional compressed gas dust blowing devices. The adapter contains a radioactive source allowing the delivery of ionically charged gas thereby dissipating the static forces which secure many of the surface adherents.

At the present time compressed gas dust blowing devices generally consist of a pressurized gas source, a valve and a nozzle or other arrangement for directing the gas flow. The pressurized gas source is usually a hand-sized aerosol type container used in conjunction with a removable trigger and valve assembly. Also in use are larger units utilizing high capacity storage tanks or compressors, providing the pressurized gas source, and separate nozzle assemblies with integral valve and trigger connected to the pressurized gas source by a flexible conduit. Pocket-sized disposable compressed gas dust blowing units with an integrated valve and nozzle are also available. All of these compressed gas dust blowing devices use pressurized gas to literally blow the dust or other particles from the surface to be cleaned.

The dominant force adhering particulate matter to surfaces such as photographic, audio and video material and equipment is often a localized static charge on the surface. For the devices presently in use to be effective, the forces resulting from the gas impinging on the particle must be sufficient to overcome the forces of adhesion. Often, gas flow capable of exerting sufficient force to dislodge a particle is neither possible nor desirable with these units. Also, once a particle is dislodged it is free to readhere, unless there is some dissipation of the localized static charge. Absent some means to dissipate these static charges, these units leave the surface with the same attractive forces ready to begin a subsequent particulate build up.

It is therefore an object of the present invention to provide an adapter for a compressed gas dust blowing device which is capable of dissipating the localized static forces on surfaces to be cleaned without harm to these surfaces or the operator of the device.

It is a further object of the present invention to provide an anti-static adapter for a compressed gas dust blowing device utilizing a radioactive source which may be used and handled safely.

SUMMARY OF THE INVENTION

The anti-static adapter of the present invention utilizes a radioactive source in an enclosed gas flow stream. The anti-static adapter of the present invention is self-contained in that the radioactive source is secured and enclosed within an ionizing chamber formed by the adapter housing or shell and is not handled directly by the operator of the device. The radioactive emissions are confined primarily to within the ionizing chamber. The upstream portion of the ionizing chamber accepts the gas nozzle of existing compressed gas dust blowing devices and permits the entrainment of air to augment the gas stream. The gas and air mixture is ionized in the ionizing chamber and exits through an outlet nozzle at a downstream portion of the ionizing chamber. The ionized gas and air mixture may be selectively directed at the surfaces to be cleaned. The adapter may be handled without any special precautions against deleterious effects of radioactivity upon the hands or body of the users.

BRIEF DESCRIPTION OF THE DRAWINGS

The present invention will be described and understood more readily when considered together with the accompanying drawings, in which.

DESCRIPTION OF THE PREFERRED EMBODIMENTS

Figure 1:
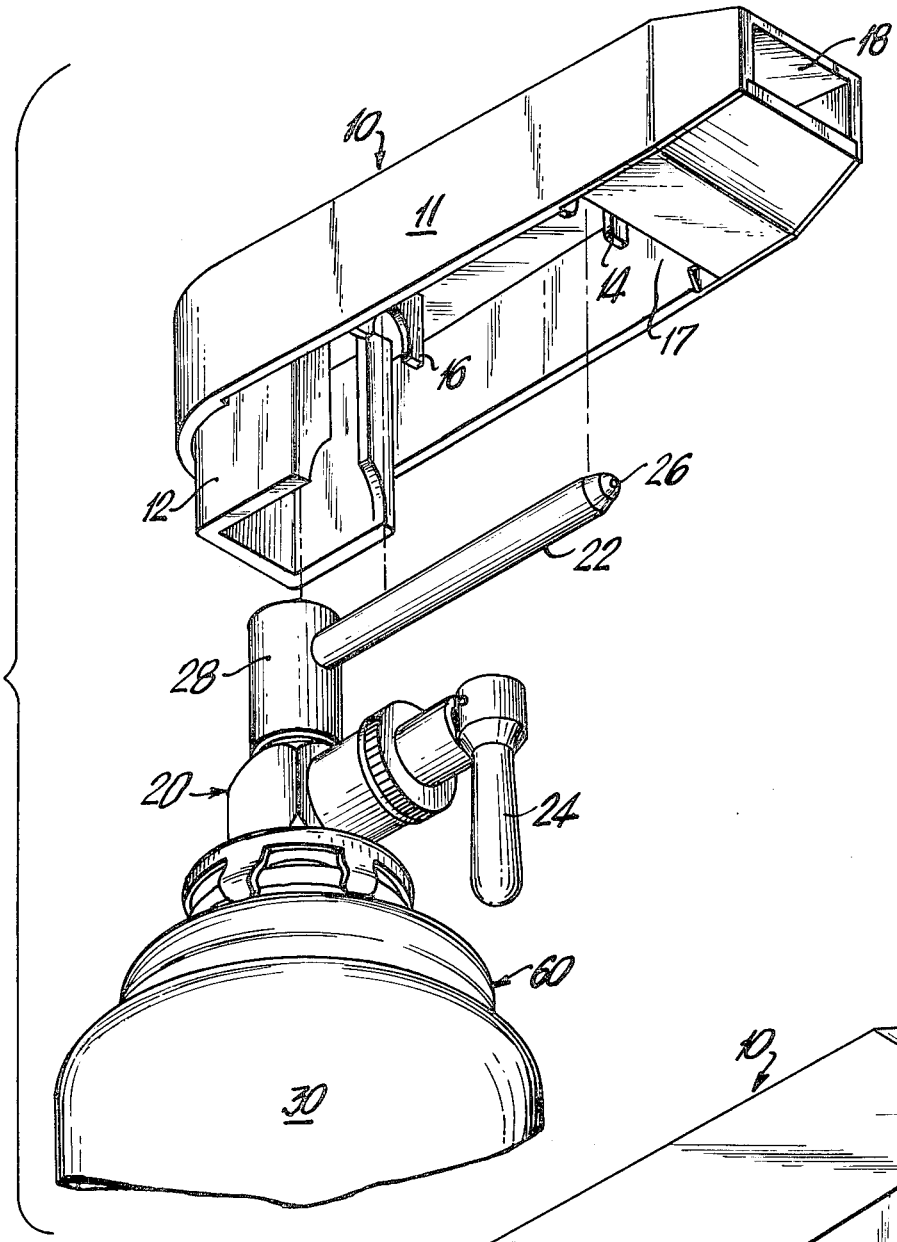
FIG. 1 is an exploded perspective view of an anti-static adapter of the present invention and an existing compressed gas dust blowing device.

Referring to the drawings, FIG. 1 shows, an anti-static adapter of the present invention generally designated 10, and an existing type of compressed gas dust blowing device generally designated 60 which itself includes a nozzle and valve assembly generally designated 20, and a pressurized gas source of aerosol gas in container 30.

The nozzle and valve assembly 20 is mounted on the container 30. A trigger 24 operates a valve within the assembly 20 and allows the flow of gas from container 30 to a tubular nozzle 22 and nozzle orifice 26 through a nozzle support conduit 28 to vent the gas released when the trigger 24 is actuated.

As shown in FIG. 1 the adapter 10 comprises an elongated housing 11 having substantially parallel side walls depending from a flat top wall, and having an open bottom. Front and rear flat parallel mounting clips 14 and 16 within the housing depend from the top wall and have arched recesses in their free ends, shaped to frictionally engage the nozzle 22 at spaced points. A hollow mounting frame 12 extends below the free edges of the sidewalls and frictionally engages the nozzle support conduit 28 to provide a means to secure the adapter to the valve and nozzle assembly. A slot is provided in the frame 12 to accommodate the nozzle 22.

Figure 2:
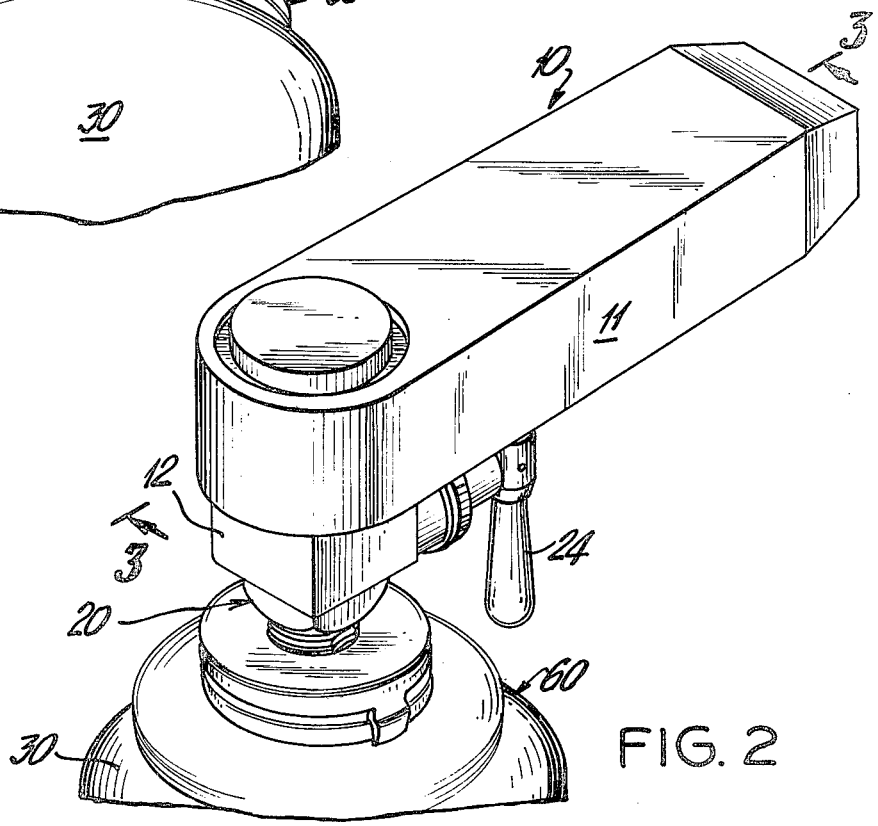
FIG. 2 is a fragmentary perspective view of said existing blowing device assembled with the anti-static adapter of FIG. 1.
Figure 3:
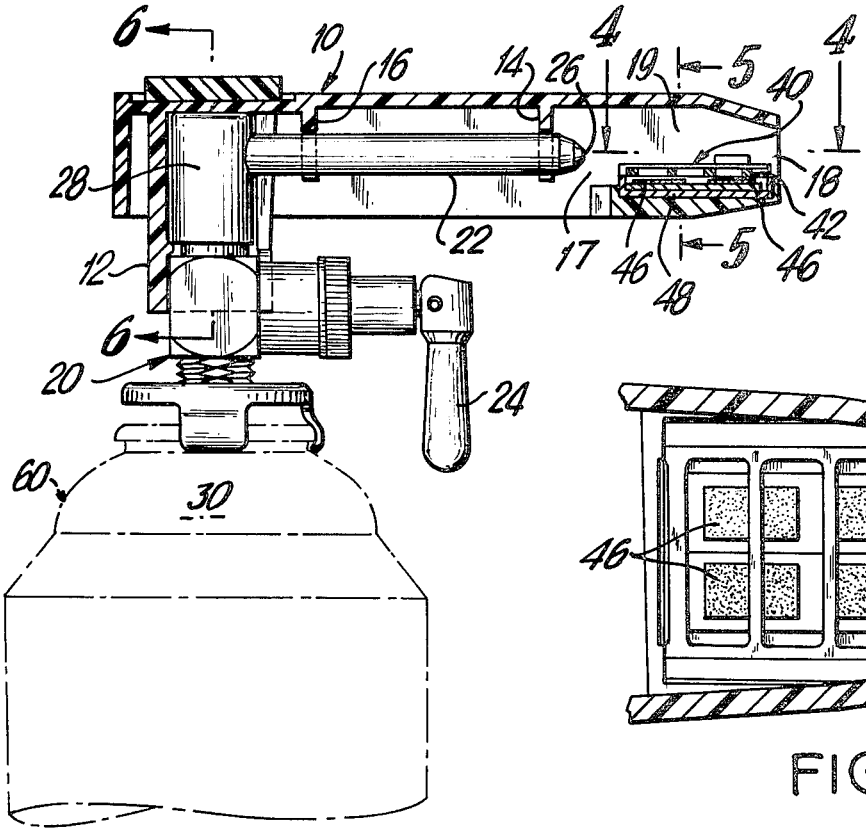
FIG. 3 is a sectional view taken along line 3—3 of FIG. 2.

FIGS. 2 and 3 show the adapter 10 snapped in place over the nozzle and valve assembly 20 and ready for use.

Figure 4:
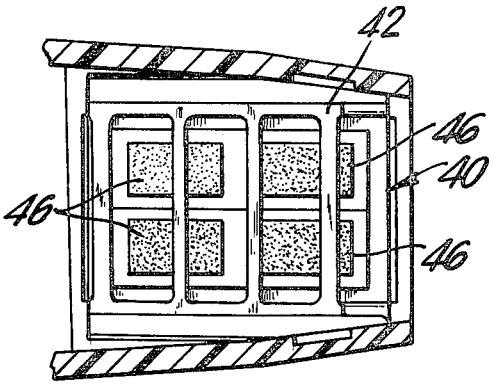
FIG. 4 is a fragmentary sectional view of the ionizing chamber portion of the adapter of the present invention containing the radioactive source, taken along line 4—4 of FIG. 3.
Figure 5:
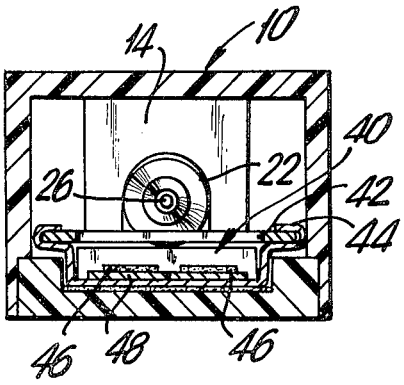
FIG. 5 is a sectional view of the adapter of the present invention taken along line 5—5 of FIG. 3.
Figure 6:
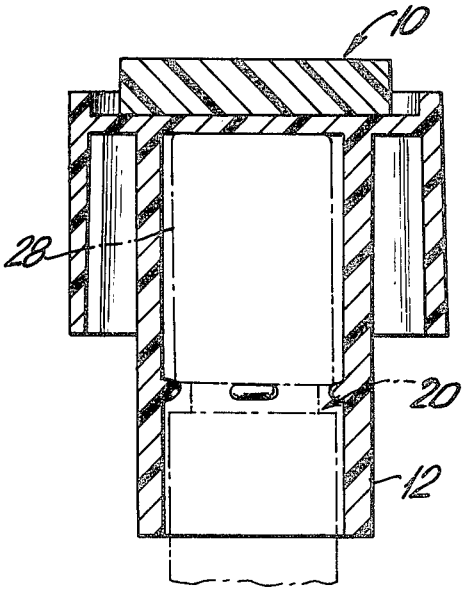
FIG. 6 is a sectional view taken along line 6—6 of FIG. 3.

Referring to FIG. 3 there is shown the ionizing chamber 19 with an inlet passage 17 at an upstream portion. The downstream portion of the ionizing chamber 19 has tapered walls to provide an outlet nozzle 18 for directing the flow of gas. A radioactive source generally designated 40 is in the form of a rectangularly shaped unit that is adhesively or otherwise secured and enclosed within the ionizing chamber 19 against the inside of the housing 11 which acts as a shield. FIGS. 4 and 5 show the radioactive source 40 as including a radioactive polonium compound 46 such as polonium salts which are absorbed into porous ceramic microspheres, bonded to a suitable substrate preferably of metallic foil 48 which is attached to a centrally depressed metal housing having reversely bent edges 44. The radioactive material emits directly into the ionizing chamber 19 through apertures in a flat protective grid 42 which is held in place by the bent edges 44.

The anti-static adapter is supplied to the user as a self-contained unit with the radioactive source 40, secured and enclosed within the ionizing chamber 19 and substantially inaccessible to the user. The radioactive emissions are confined primarily to within the ionizing chamber 19. When the emissions from the radioactive source after the passage of time, e.g., a year or more, have subsided to a level insufficient to ionize the gas and air mixture the entire anti-static adapter may be returned to the manufacturer or disposed of by burial.

The operation of the present invention may be readily understood by refering to FIGS. 3–5. With the anti-static adapter 10 in place on the nozzle and valve assembly 20, the operation of the trigger 24 causes a flow of gas through the orifice 26 into the inlet section 17 of the ionizing chamber 19. Air is drawn through the inlet section 17 when the gas flow is initiated. The air mixes with the gas and the mixture is ionized by the emissions from the decay of the radioactive source 40 in the ionizing chamber 19 before passing through the outlet nozzle 18.

The resulting gas flow issuing from the outlet nozzle 18, performs the dual functions of eliminating static charges from the surfaces to be dusted and carrying away the particles.

Figure 7:
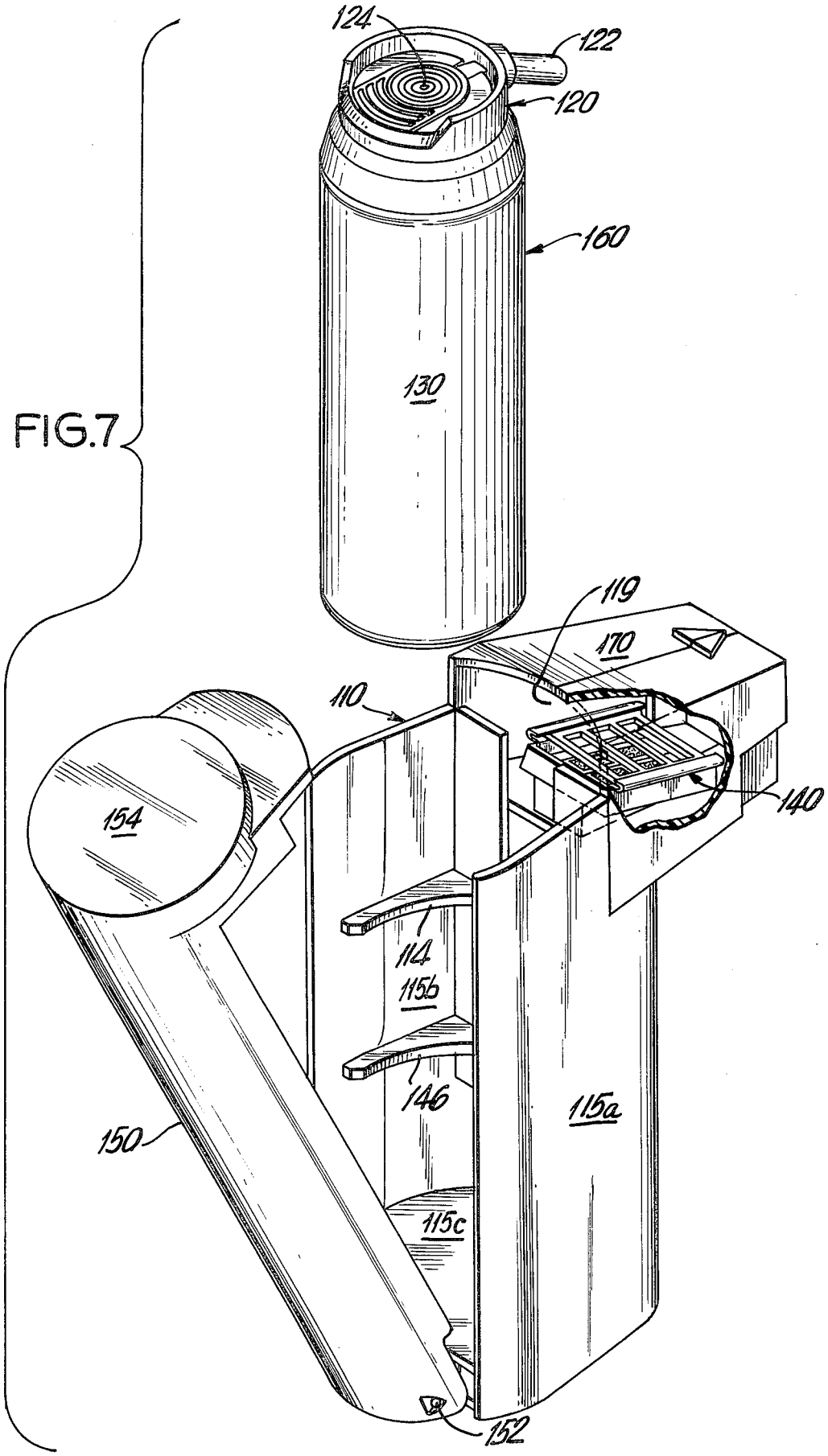
FIG. 7 is an exploded perspective view of a second embodiment of the present invention together with alternate type of existing compressed gas dust blowing device.
Figure 8:
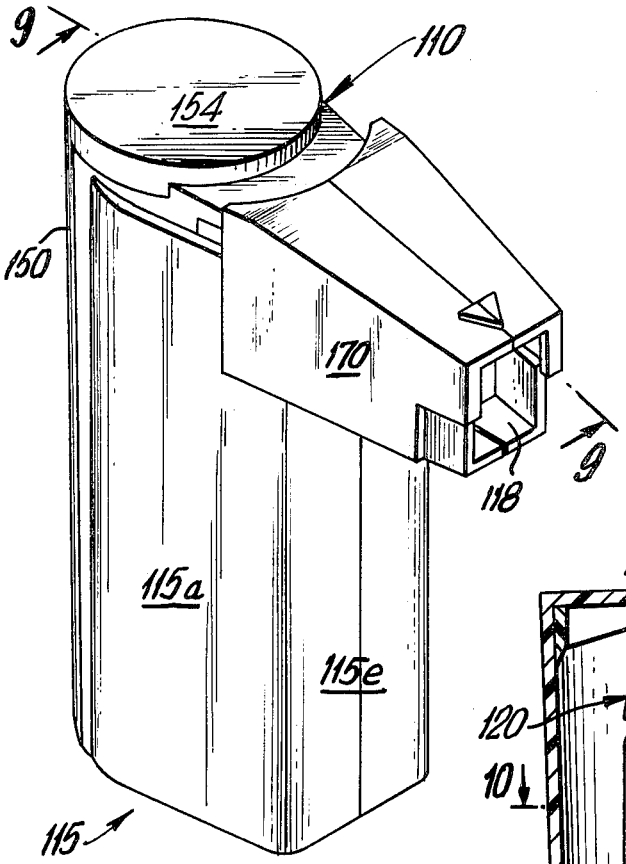
FIG. 8 is a perspective view of the second embodiment of the anti-static adapter of the present invention.
Figure 9:
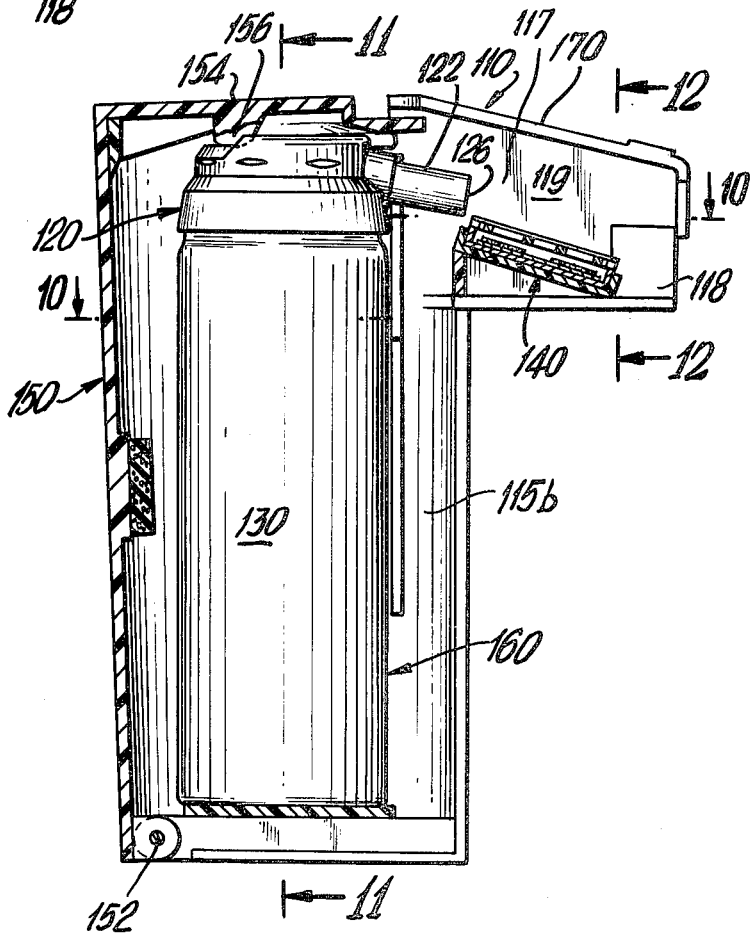
FIG. 9 is a vertical sectional view taken along line 9—9 of FIG. 8.
Figure 10:
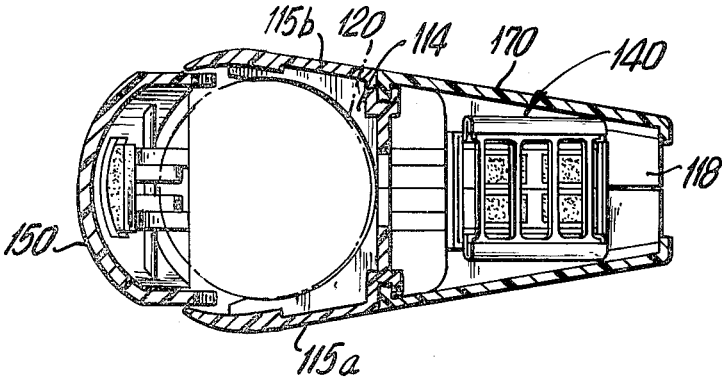
FIG. 10 is a horizontal sectional view taken along line 10—10 of FIG. 9 with the container removed.
Figure 11:
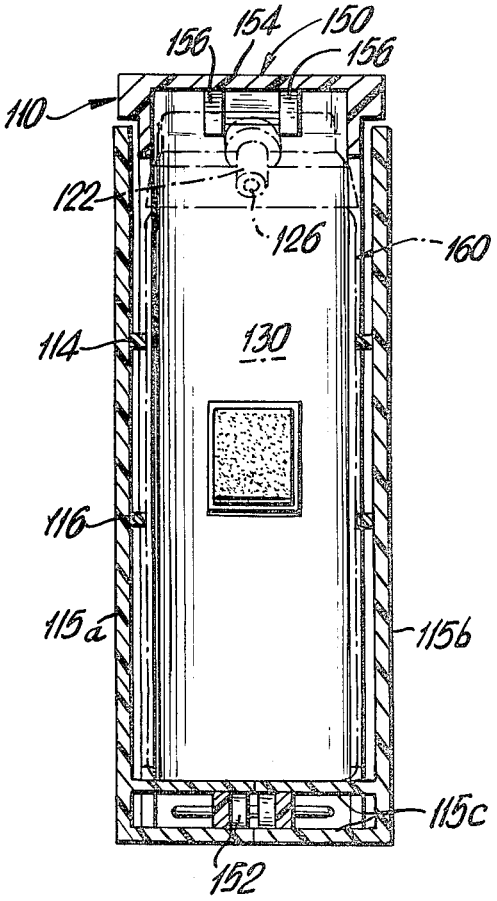
FIG. 11 is a vertical sectional view taken along line 11—11 of FIG. 9 with container shown in dashed lines.
Figure 12:
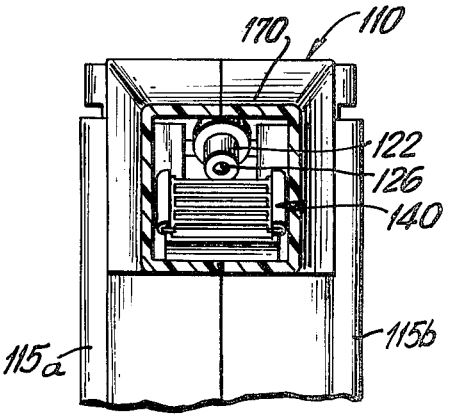
FIG. 12 is a partial vertical sectional view taken along line 12—12 of FIG. 9.

There is shown in FIGS. 7 through 14 a second embodiment of the present invention which is designed for use with another known type of compressed gas dust blowing device which itself is an integrated assembly of pressurized gas source, valve, actuating mechanism and nozzle. FIGS. 7 through 9 show the second embodiment, generally designated 110, in connection with said existing compressed gas dust blowing device generally designated 160. The blowing device 160 has a pressurized gas container 130, and an actuator assembly generally designed 120 with a depressible actuating button 124, which when depressed opens a valve (not visible) permitting a gas stream to flow through the nozzle 122 and from its orifice 126.

Figure 13:
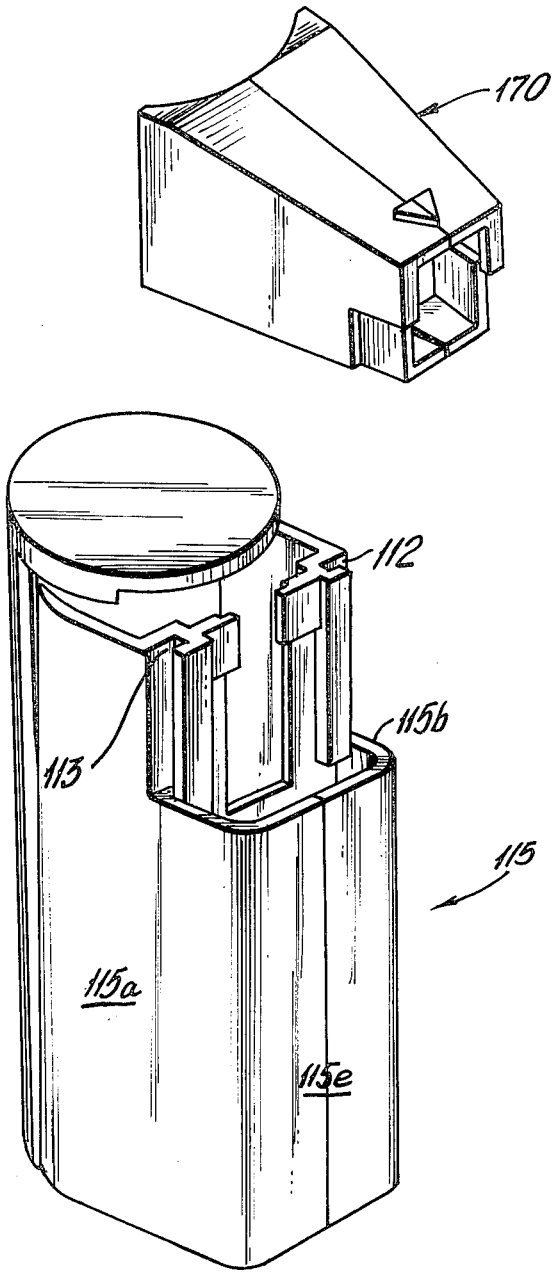
FIG. 13 is an exploded perspective view of the second embodiment showing the housing separated from the front shell.
Figure 14:
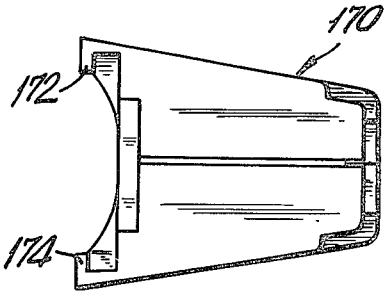
FIG. 14 is a bottom view of the housing of the second embodiment.

As best shown in FIGS. 7 & 13, the anti-static adapter 110, has a front shell 115, to which a housing 170 may be slidably attached.

The front shell 115 is formed from two substantially mirror-image molded abutting parts which when joined provide a substantially channel shaped structure with facing substantially parallel side walls **115*a*, 115*b* and a flat double bottom wall 115*c* perpendicular thereto, and a connecting end wall 115*e*. In the mid-portion of the front shell, spaced flat shelf-like arcuate arms 114, 146 are provided to embrace and frictionally hold the container 130 as it is inserted sidewise between the sides 115*a*, 115*b* and pressed past the enlarged tips of the arms 114, 146**.

Slidably attached to the front shell 115 is a hollow housing 170 which performs the dual functions of an ionizing chamber and nozzle. The housing 170 is formed of two mirror-image parts which abut and are adhered together at their abutting edges. For such slidable attachment, oppositely facing aligned tongues 172, 173 (see FIG. 13) are formed on the entrance end of the ionizing housing to fit into outwardly open longitudinal grooves 112, 113 formed in the upper portions of the shell parts **115*b*, 115*a***.

From their points of attachment to the shell halves **115*a*, 115*b*, the halves of the ionizing housing taper to the opposite or outlet end of the housing, thereby forming a nozzle. Within the ionizing chamber 119, there is mounted a radioactive source 140, like the source 40 in FIGS. 3–5. As the compressed fluorocarbon or other compressed gas from the container 130 issues from the container outlet nozzle 122, it passes over the radioactive source 140 along with air entrained through an inlet section 117 at the upstream end of the ionizing chamber 119. The outlet or nozzle end 118** directs the ionized gaseous mixture wherever the user desires.

For controlling the flow of gas from the container a rear shell, designated generally by numeral 150, is provided being approximatelfy a quadrant of a cylinder and of length approximating the length of the front shell 115. A pivotal connection between the shell parts 115 and 150 at their bottoms by a pin 152 passing thru cooperating interleaved lugs formed on adjacent portions of the front and rear shells, enables the rear shell to be moved away from and toward the front shell for insertion of the container 130 and depression of its operating button 124 respectively as will now be described. The top portion 154 of the rear shell is preferably circular and covers the top of the container. On the inner surface of the top 154 an inclined cam 156 is molded, which is adapted to engage and depress the operating button 124 of this gas container 130, as the shell 150 is pressed and its top moves over the container.

When the adapter is squeezed to the fully closed position by bringing the rear shell 150 up the front shell 115, the cam 156 pushes on the operating button 124 causing it to open the valve (not visible) within the assembly 120 and initiating the flow of gas.

Modifications within the scope of the invention will occur to those skilled in the art. Therefore, the invention is not limited to the specific form of the embodiments described.

What is claimed is:

1. A self-contained anti-static adapter for attachment to a compressed gas dust blowing device, said adapter for entraining air with a stream of gas from said blowing device and ionically charging this gaseous mixture to reduce forces of static attraction on surfaces to be dusted, the adapter comprising;

a housing;

securing means to secure the adapter to said blowing device;

an ionizing chamber formed within the housing, the ionizing chamber comprising:

an inlet at an upstream portion of the ionizing chamber to conduct a stream of gas from said blowing device and to entrain air in the gas stream, a radioactive source to ionize the mixture passing through the ionizing chamber, the radioactive source being secured and enclosed within the ionizing chamber to physically shield the radioactive source and to confine the radioactive emissions primarily to within the ionizing chamber, an outlet nozzle located at a downstream portion of the ionizing chamber to direct the stream of the ionizing mixture;

a front shell;

secondary securing means to secure the housing to the front shell;

a rear shell pivotally connected with the front shell, the front shell and rear shell together forming an enclosure for said blowing device; and actuator means connected integrally with at least one of the shells to actuate said blowing device when the front shell and rear shell are squeezed together.

2. The self-contained anti-static adapter of claim 1 in which the radioactive source comprises a radioactive polonium compound which is absorbed into ceramic microspheres, the microspheres being bonded to a substrate.

3. The adapter of claim 2 wherein the compressed gas dust blowing device comprises a container of fluorocarbon gas and a valve for controlling the flow of said gas.

4. A self-contained anti-static adapter for attachment to a compressed gas dust blowing device, said adapter for entraining air with a stream of gas from said blowing device and ionically charging this gaseous mixture to reduce forces of static attraction on surfaces to be dusted, the adapter comprising:

a housing;

securing means to secure the adapter to said blowing device comprising:

a front mounting clip and a rear mounting clip connected integrally with the housing to engage frictionally a nozzle of said blowing device, and a mounting frame connected integrally with the housing to engage frictionally a nozzle support conduit of said blowing device;

a ionizing chamber formed within the housing, the ionizing chamber comprising:

an inlet at an upstream portion of the ionizing chamber to conduct a stream of gas from said blowing device and to entrain air in the gas stream, a radioactive source to ionize the mixture passing through the ionizing chamber, the radioactive source being secured and enclosed within the ionizing chamber to physically shield the radioactive source and to confine the radioactive emissions primarily to within the ionizing chamber, and an outlet nozzle located at a downstream portion of the ionizing chamber to direct the stream of the ionized mixture.

5. A self-contained anti-static adapter for attachment to a compressed gas dust blowing device, said adapter for entraining air with a stream of gas from said blowing device and ionically charging this gaseous mixture to reduce forces of static attraction on surfaces to be dusted, the adapter comprising:

a front shell;

a front shell support means to engage said blowing device;

a housing;

an ionizing chamber formed by the housing, the ionizing chamber including, an inlet at an upstream portion of the ionizing chamber to conduct a stream of gas from said blowing device and to entrain air in the gas stream, a radioactive source to ionize the mixture passing through the ionizing chamber, the radioactive source being secured and enclosed within the ionizing chamber to physically shield the radioactive source and to confine the radioactive emissions primarily to within the ionizing chamber, and an outlet nozzle located at a downstream portion of the ionizing chamber to direct the steam of the ionized mixture;

securing means to secure the housing to the front shell;

a rear shell pivotally connected with the front shell, the front shell and rear shell together forming an enclosure for said blowing device; and actuator means connected integrally with at least one of the shells to actuate said blowing device when the front shell and rear shell are squeezed together.

6. The self-contained anti-static adapter of claim 5, wherein the actuator means is integral with the rear shell.

7. The self-contained anti-static adapter of claim 5, in which the radioactive source comprises a radioactive polonium compound which is absorbed into ceramic microspheres, the microspheres being bonded to a substrate.

8. The self-contained anti-static adapter of claim 5 in which the securing means comprises tongue and groove means on the housing and the front shell providing sliding engagement for assembling the housing and front shell.

9. The self-contained anti-static adapter of claims 5 or 8 in which the support means comprises arcuate arms, integral with the front shell for frictionally engaging said blowing device.

10. The adapter of claim 9 wherein the compressed gas dust blowing device comprises a container of fluorocarbon gas and a valve for controlling the flow of said gas.

11. The adapter of any of claims 1, 5, 6, 7 or 8 wherein the compressed gas dust blowing device comprises a container of fluorocarbon gas and a valve for controlling the flow of said gas.

* * * * *